United States Patent [19]

Goldstein

[11] 4,067,174

[45] Jan. 10, 1978

[54] STRETCH WRAP MACHINE

[76] Inventor: Joseph Goldstein, 9838 Chicopee Ave., Northridge, Calif. 91325

[21] Appl. No.: 752,444

[22] Filed: Dec. 20, 1976

[51] Int. Cl.[2] ..... B65B 13/10

[52] U.S. Cl. ..... 53/184 R; 53/198 R; 53/210; 53/218

[58] Field of Search ..... 53/139.3, 184 R, 196, 53/198 R, 210, 218; 100/27; 180/79, 98, 131

[56] References Cited

U.S. PATENT DOCUMENTS

| | | | |
|---|---|---|---|
| 2,057,061 | 10/1936 | Eggerss | 53/139.3 |
| 2,549,136 | 4/1951 | Simpson et al. | 53/139.3 |
| 2,925,875 | 2/1960 | Bourdon | 180/131 |
| 3,393,762 | 7/1968 | Matson | 180/131 X |
| 3,669,209 | 6/1972 | Brooke | 180/98 |
| 3,763,955 | 10/1973 | Schroder et al. | 180/98 |
| 3,793,798 | 2/1974 | Lancaster | 53/196 X |
| 3,853,051 | 12/1974 | Tyler | 53/139.3 X |
| 3,853,069 | 12/1974 | Goodwin | 180/79 |
| 3,881,568 | 5/1975 | Ando et al. | 180/98 |
| 3,910,005 | 10/1975 | Thimon et al. | 53/198 R X |

*Primary Examiner*—Travis S. McGehee
*Assistant Examiner*—John Sipos
*Attorney, Agent, or Firm*—Allan M. Shapiro

[57] ABSTRACT

Motive unit carries stretch wrap unit around stationary material to be wrapped. Motive unit is preferably self-propelled and is preferably self-guided by means of a track follower, although manual motive unit guide controls are provided.

12 Claims, 11 Drawing Figures

Fig. 6
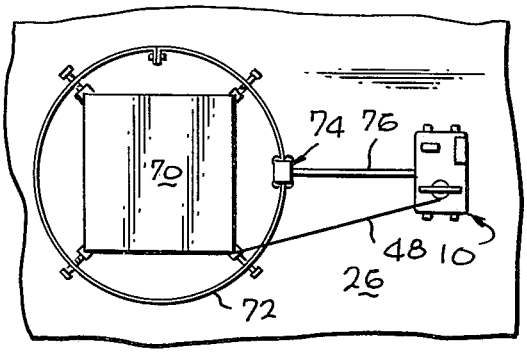
Fig. 5
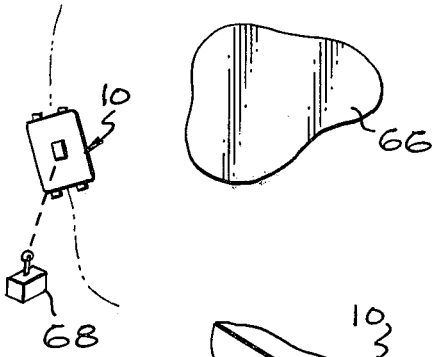
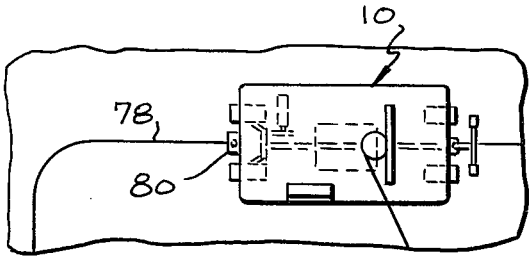
Fig. 8
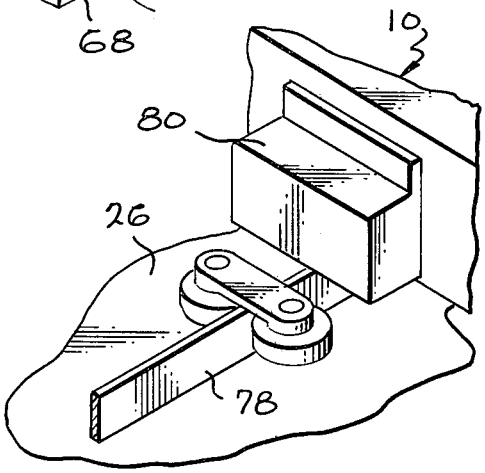
Fig. 7
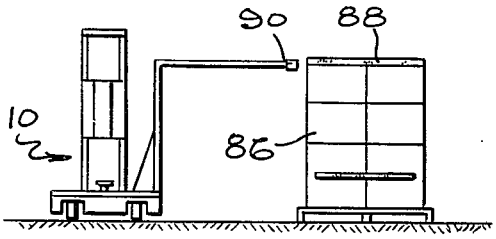
Fig. 10
Fig. 11
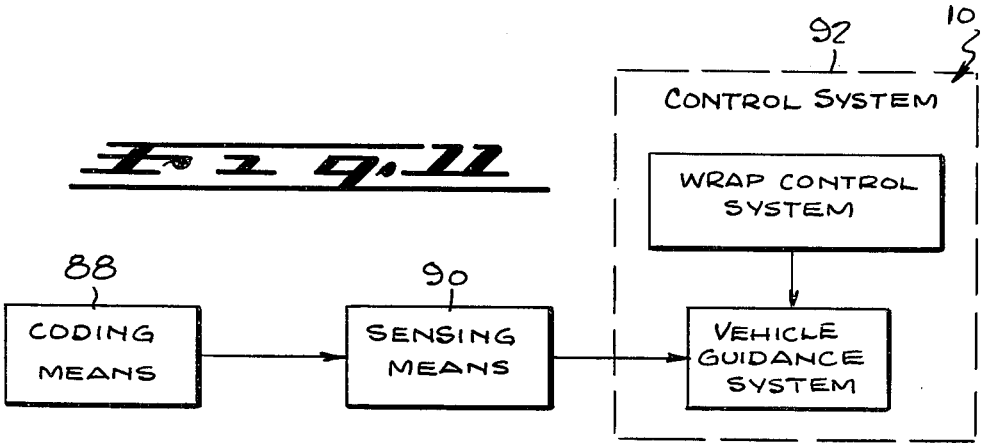

STRETCH WRAP MACHINE

BACKGROUND OF THE INVENTION

1. Field of the Invention

This invention is directed to a stretch-wrap machine wherein a motive unit carries a stretch-wrap unit around material to be wrapped.

2. Description of the Prior Art

Modern mechanized handling requires that a number of small packages be packed together so that they can be handled in larger units. Pallets are used as a base, and packages are stacked on the pallet to a convenient size and weight for mechanical handling. One approach to retaining the packages on the pallet has been steel banding. Steel bands were placed around the packages and the pallet and the bands tightened and clamped. The problem with steel banding is that loads can shift, and under the wrong circumstances, all the packages on the outer extremities of the load directly under the steel bands can be crushed. Furthermore, the steel bands are difficult and dangerous to handle. Steel bands are most useful on heavy metals objects, such as pipe and other forms of steel. It must be noted that steel banding does not provide any weather protection for the packages.

A newer method of securing packages on a pallet to provide a palletized load is to shrink wrap the packages and the pallet. In this arrangement, bags are made out of shrink material (usually polyethylene), and the bag is placed over the palletized packages. Thereupon, the bag is subjected to heat whereupon it shrinks to unitize the palletized load. Shrink wrap is useful for loads which are of uniform size, but requires special equipment for causing the shrinkage. Since heat is used to cause the shrinkage, it cannot be used in cold rooms or other areas where high heat loads are objectionable. Furthermore, it cannot be used over polyethylene wrapped packages because of sticking between the shrink wrap material and such packages.

To overcome these disadvantages, stretch-wrapping has been developed. In these machines, one of which is seen in Lancaster, U.S. Pat. No. 3,867,806 a stack of packages is placed on a turntable. Usually, these packages are mounted on a pallet. The turntable is rotated, and the palletized load of packages is wrapped with a stretch-wrap material. This material may be polyethylene or polyvinylchloride web or film and is manufactured to be able to stretch at least 25 percent. During wrapping of the load, tension on the stretch-wrap film provides a tension which stretches the film from 15 to 25 percent. The film is thin, usually about 1/1000th of an inch, and the load is wrapped with as many thicknesses as is necessary to obtain the desired unitized load strength.

The stretch-wrap film may be as tall as the load or may be narrower than the height of the load. In the latter case, the narrower film is spiral-wrapped around the load. Since more wraps are necessary at the top and bottom of the load than at the middle for best strength, this is more economical of material. However, these stretch-wrapped concepts have been limited to those loads which can be placed on the turntable and rotated.

SUMMARY OF THE INVENTION

In order to aid in the understanding of this invention, it can be stated in essentially summary form that it is directed to a stretch-wrap machine which comprises a motive unit carrying a stretch-wrap unit for tension release of stretch-wrap film so that, as the motive unit is moved around the material to be stretch-wrapped, wrapped is accomplished.

It is thus an object of this invention to provide a stretch-wrap machine which is capable of moving around a unit to be wrapped so that stretch-wrap on the motive unit can be released with tension to wrap stationary loads. It is a further object to provide a stretch-wrap machine wherein the stretch-wrap unit is moved around the structure to be packaged while the structure to be packaged stands stationary. It is a further object to provide a stretch-wrap machine motive unit which is capable of being guided around the structure to be wrapped by any one of a plurality of selectable motive unit guidance means.

It is a further object to provide a stretch-wrap machine which is capable of stretch-wrapping irregular loads or large loads by traveling around the load while releasing stretch-wrap film. It is another object of this invention to provide a stretch-wrap machine which is economic of use and is capable of wide utility in the kinds of loads it can wrap.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 5 schematically shows a top-plan view of another preferred embodiment of the stretch-wrap machine where it is manually guided on an irregular travel track by the operator.

FIG. 6 shows another preferred embodiment of the stretch-wrap machine where the machine is provided with a mechanical follower and follows a mechanical track.

FIG. 7 is a perspective view of one embodiment of the mechanical track guide mechanism.

FIG. 8 is a schematic top-plan view of an embodiment of the stretch-wrap machine of this invention wherein it follows a guide track by electromagnetic coupling.

FIG. 10 is a side-elevational view of another preferred embodiment of the stretch-wrap machine of this invention wherein optical scanning by the machine of coding on the structure being stretch-wrapped guides the stretch-wrap machine.

FIG. 11 is a schematic diagram of the system for guidance illustrated in FIG. 10.

DESCRIPTION OF THE PREFERRED EMBODIMENT

Figure 1:
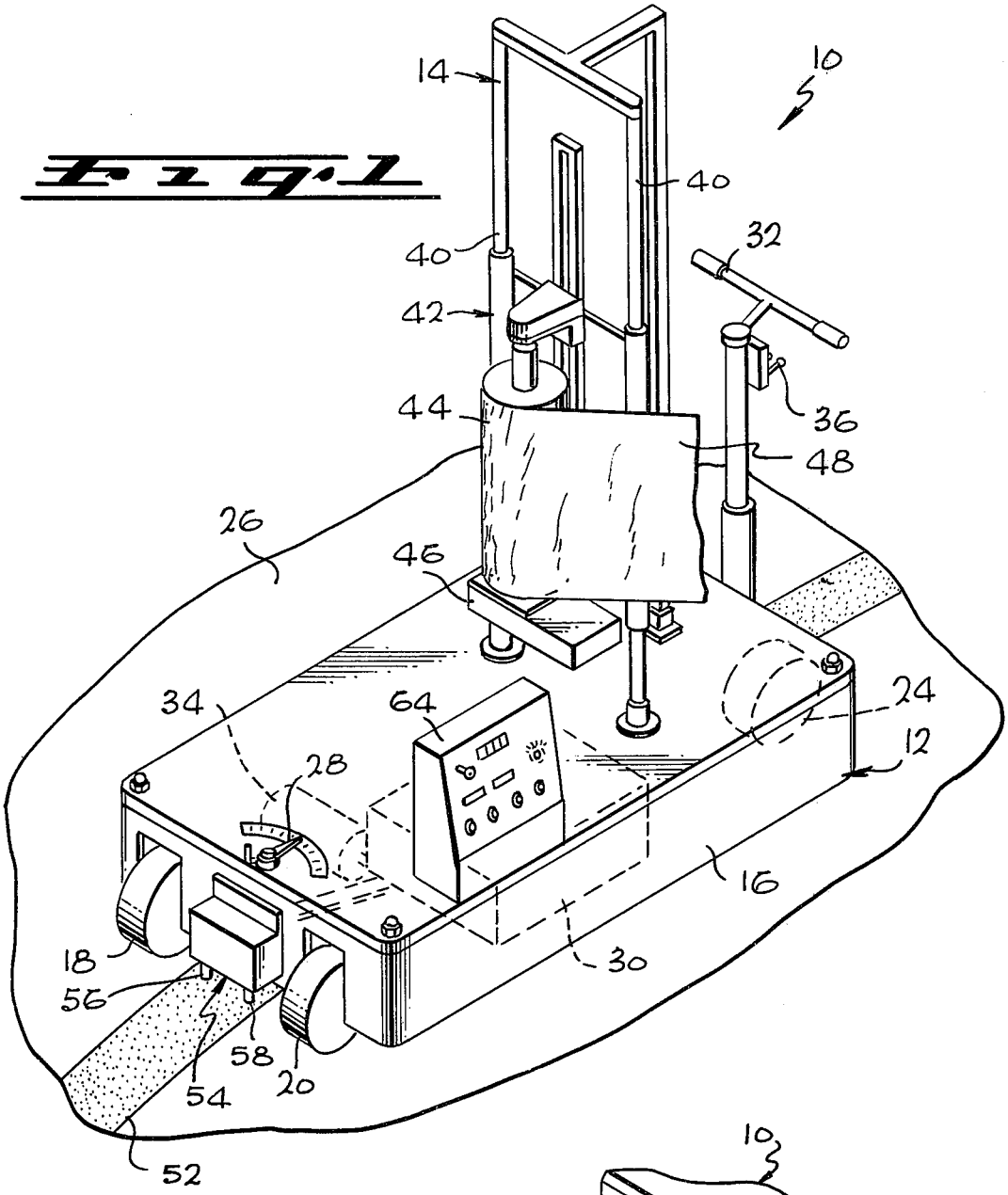
FIG. 1 is a perspective view of a preferred embodiment of the stretch-wrap machine of this invention.
Figure 2:
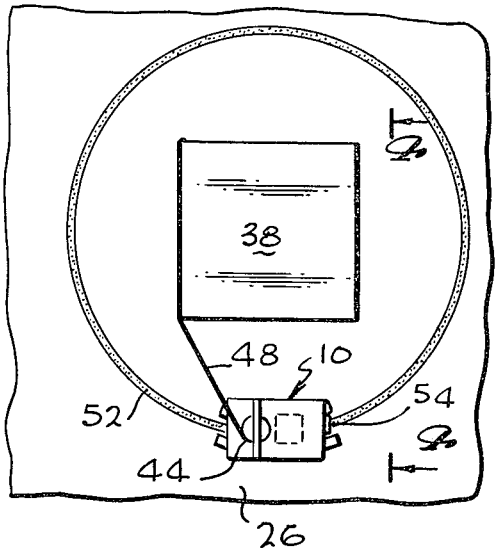
FIG. 2 is a top-plan view of the stretch-wrap machine of FIG. 1 showing it optically guided on a circular track and proceeding around a load being stretch-wrapped.

Stretch-wrap machine 10 is illustrated in FIG. 1. It comprises motive unit or vehicle 12 which carries on its top stretch-wrap control unit 14. Motive unit 12 has frame 16 which is supported on front wheels 18 and 20 and rear wheels 22 and 24, see FIG. 3. The wheels support the stretch-wrap machine with respect to floor 26 as well as propel and guide the machine on the floor. All four wheels may steer (as is shown in FIG. 2) to aid the machine in making turns, and all four wheels may propel the machine on its course. On the other hand, the propulsion and steering function may be separated with some of the wheels steering and some of them propelling. Further, the motive unit may be structured so that one wheel propels and steers and provides a major part of the support, while two other wheels merely support. The configuration of the motive unit shown is merely illustrative, and it need only supply the functions of controllable forward propulsion and guidance of the stretch-wrap control unit 14.

With the present stretch-wrapping invention, the wrapping material is wound a number of times around the material to be wrapped, which is stationary. The control of the path of the motive unit can be accomplished in a number of different ways. In the motive unit 12, given as a preferred example of a motive unit, front wheels 18 and 20 are steerable. In the first manner in which the stretch-wrap machine 10 can be moved around a stationary material to be wrapped, the steerable front wheels 18 and 20 are directed at a predetermined steering angle, as indicated by steering indicator 28, to move the stretch-wrap machine around a circle of known radius and is locked so that the machine continues to move in a circle. Battery 30 powers the propulsive rear wheels. In this way, the stretch-wrap machine moves in a circle around the stationary material to be wrapped.

When there are a number of circuits around the circle, it can be seen that the circular path of stretch-wrap machine 10 may drift with respect to the stationary material to be wrapped, and such is undesirable. Thus, instead of being locked on a particular radius, the motive unit might be directed by manual control of manual steering handle 32 which controls the steerable front wheels through steering servo 34. Steering servo 34 is in effect a power steering unit which can receive signals for steering or guiding of the motive unit to direct the motive unit on the desired course. When manual steering handle 32 is used manual control 36 of the propulsion of the motive unit can also be used.

Figure 4:
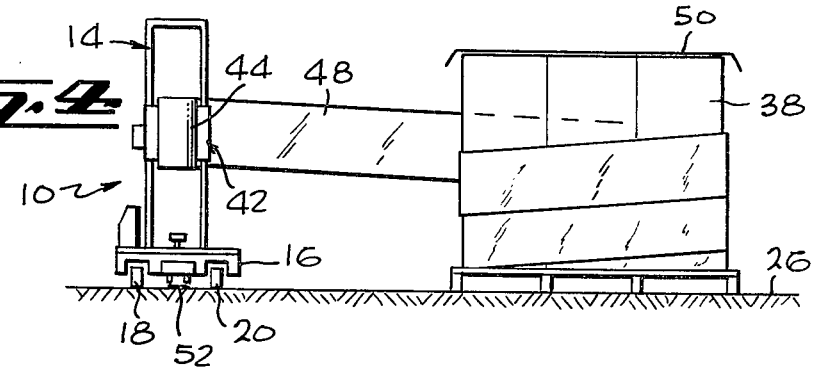
FIG. 4 is a side-elevational view of the structure shown in FIG. 2, as seen along the line 4—4 of FIG. 2, showing the vertical organization of the machine.

It is thus seen that motive unit 12 can be moved a plurality of times around a stationary assemblage of material to be wrapped. FIGS. 2 and 4 illustrate a plurality of packages stacked on a pallet as the material to be wrapped and the material is identified in those figures generally at 38. Stretch-wrap control unit 14 includes upright rails 40 which carry movably reciprocatable carriage 42. Carriage 42 carries stretch-wrap material roll 44 which is rotatably wrapped for controlled letoff tension by means of tension control unit 46. Web 48 is let off stretch-wrap material roll 44 under controlled, predetermined tension. As described in the background, web 48 may be sufficiently wide to fully engage the height of material 38 or it may be narrower than the height of material 38, as shown in FIG. 4. In this case, carriage 42 is propelled up and down its rails 40 to spirally wrap material 38, as shown in FIG. 4. Additional wraps may be laid around the top and bottom of material 38 to give additional strength to the packaging. Cover sheet 50 may be laid over material 38 prior to the peripheral wrapping to protect the top of material 38. As the web 48 is spirally wrapped upward on the material 38, it engages around the edges of the cover sheet to supply some protection to material 38.

Figure 3:
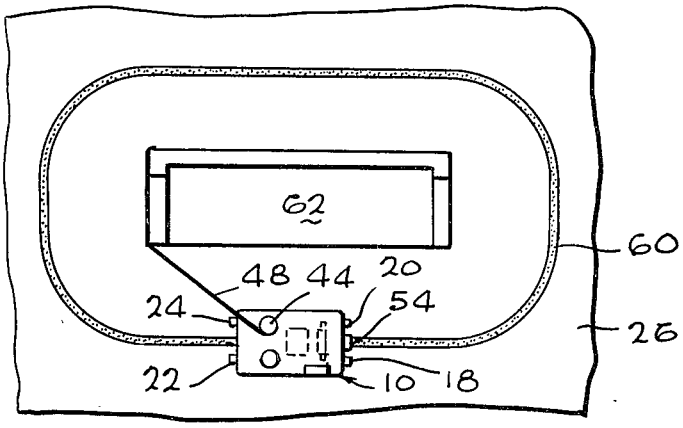
FIG. 3 is similar to FIG. 2, but showing the machine optically following an elongated track to stretch-wrap an elongated load.

With this organization, it can be understood that manual control of motive unit 12 in its course around the material 38 to be wrapped is time-consuming. Furthermore, locking the steering may produce undesirably uneven passage. Thus, more controlled means for control of the direction of the motive unit is desirable. In FIGS. 1 through 4, the preferred guidance of the motive unit is by optically following a guide track. Guide track 52 is in the form of a painted strip or an applied tape layer, or the like, of optically differing characteristics than floor 26. The difference can be in color, brightness, or reflectivity so that the different characteristics can be optically detected. Optical tracker 54 is mounted on the front of motive unit 12 and the detectors 56 and 58 laterally spaced thereon. The detectors detect the edges of the guide track and steer motive unit 12 through servo 34 and back so that both of the detectors are over the track. Guide track 52 is seen in FIGS. 1, 2 and 4 as circular while track 50 in FIG. 3 is rectangular in configuration with curved corners. Guide track 60 is of particular use in wrapping an elongated stationary load 62 of material to be wrapped, for example, a long crate or a couch or other similar piece of furniture. Thus, the optical guide track is a convenient way to guide the stretch-wrap machine as it traverses its path. Control unit 64 on stretch-wrap machine 10, as seen in FIG. 1, controls the speed and the number of circuits the machine makes around the stationary load to be wrapped in conjunction with the traverse of carriage 42 on its guide so that the desired amount of overlap and the desired number of turns in stretch-wrap, as well as the desired stretch-wrap tension are achieved.

FIG. 5 illustrates that stretch-wrap machine 10 can be guided around an irregular load 66 to be wrapped by means of a separate manual control 68. Manual control 68 is in the form of a joystick which can be controlled by the operator as he stands beside the wrapping operation. Such joystick operation saves operator time and effort, and the operator can be working at other tasks (such as starting or guiding another stretch-wrap operation with another stretch-wrap machine 10 adjacent the first one), and thus his time can be doubly utilized. A separate manual control, as illustrated in FIG. 5, can be especially useful when each of the loads is of a different size, shape and configuration. In this embodiment of greatest flexibility, the carriage traverse of the stretch-wrap material can also be controlled from manual control 68.

In more permanent installations where the size and shape of the material to be wrapped is more uniform over a longer period of time, a mechanical guidance track can be used. In FIG. 6, stretch-wrap machine 10 is guided around material-to-be-wrapped 70 on circular guide track 72. The guide track 72 is an upstanding ring and is secured to the corners of the load of material 70 so that the position of the track is directly related to the position of the material to be wrapped. Track follower 74 has rollers which follow the upstanding track 72. Track follower 74 is mounted on control arm 76 which is secured to machine 10 so that machine 10 follows an appropriate circular path around the outside of track 72.

In FIGS. 7 and 8, guide track 78 is an upstanding rail mounted on the floor 26 outside of the area in which the load to be wrapped is located. Track follower 80 is secured to the front of stretch-wrap machine 10 and guides the machine around the track. Guidance may either be by direct guidance (in which case the front wheels of the machine are casters) or may be in control of servo 32 for steering and guidance of the machine around the track. The track may be circular or rounded rectangular, as illustrated in FIGS. 7 and 8.

Figure 9:
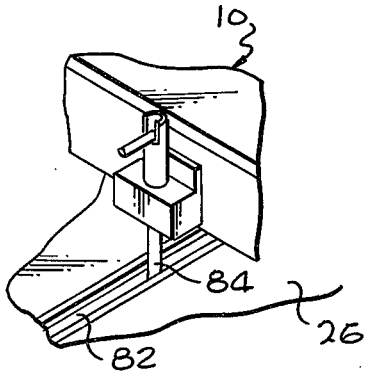
FIG. 9 is a fragmentary perspective view of another machanical guide structure wherein a pin on the machine follows a recessed track.

FIG. 9 illustrates stretch-wrap machine 10 as being guided on a U-shaped track 82. In this case, the track follower is pin 84 which is mounted on the front machine and engages in the track to follow the track and guide the machine. The track follower may be rigidly secured to the front of the machine for its guidance, in which case the front wheels of the machine are casters, or the track follower pin may be movably mounted to control servo 34 which in turn steers the front wheels to follow the track. As shown, track follower pin 84 can be lifted out of the track and turns to lock out of the way when track following is not desired. Track 82 can either be recessed into the floor 26, as shown as being the preferred structure, or may be mounted on the top of the floor. On the top of the floor, guide track 82 is cheaper and easier to install and is more easily changed, but is in the way if a more level floor surface is desired.

FIG. 10 illustrates stretch-wrap machine 10 being guided around load 86 of material to be wrapped. In this case, strip 88 of digital coding is positioned around the load, and sensor 90 on the machine is brought up to the digital coding. Control system 92 on machine 10 (see FIG. 11) interprets the digital coding, guides the motive unit, and controls the stretch-wrap control system. In this way, flexibility is achieved in that no track is required on the floor, but digital coding for each set of material to be wrapped controls the stretch-wrap machine so that an optimum wrap is achieved in each case without the need for personal attention to the machine. In this case, the digital coding is a track which is followed by the stretch-wrap machine, and the track (in addition to controlling the path of the machine) also controls the wrap tension and carriage traverse for optimum wrap conditions.

Control unit 64, showwn in FIG. 1, has similar characteristics in that it controls the stretch-wrap unit 14 as a function of progress of the motive unit along its path. As previously described, the spiral wrap is a function of position, and thus control unit 64 is a similar type of interrelating computer. It may be digital or analog, depending on needs.

The combination of the stretch-wrap unit with its controls, together with a motive unit which moves the stretch-wrap unit around the stationary load of material to be wrapped thus provides great advantages because the size or balance of the load is of no limitation to the wrapping thereof. Furthermore, the equipment is economic because it can be ueed in wrapping different configurations in different areas. In fact, the stretch-wrap being mobile may be taken to the assemblage to be wrapped, rather than having to bring the assemblage of materials to the wrapping machine. Thus, the stretch-wrap machine 10 can be used to wrap similar packages to those previously wrapped, but can also be use in other locations for wrapping other structures so that the utility of stretch-wrapping is very much broadened.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A mobile stretch-wrap machine for stretch-wrapping stationary material comprising:

a vehicle having wheels supporting it for steerable movement on a floor and capable of moving to the site of said stationary material and then moving on the floor around said material;

motive means for propelling said vehicle on the floor;

guidance control means for guiding the vehicle along a path which passes around the stationary material to be wrapped; and a stretch-wrap unit mounted on said vehicle for movement therewith along the floor and including a supply of stretch-wrap web and means for releasing said web to wind the stretch-wrap web around the stationary material as said vehicle moves on the floor and carries said stretch-wrap unit around the stationary material to be wrapped.

2. The stretch-wrap machine of claim 1 wherein said guidance control means is optical.

3. The stretch-wrap machine of claim 2 wherein an optical sensor is mounted on said vehicle to optically detect a guide track on the floor to guide said vehicle with respect to the guide track.

4. The stretch-wrap machine of claim 3 wherein said sensor comprises first and second detectors directed toward the floor for detecting the edges of an optically visible strip on the floor.

5. The stretch-wrap machine of claim 1 wherein said guidance control means comprises a mechanical track mounted with respect to the floor and a mechanical track follower mounted on said vehicle and engaged with said mechanical track so that said vehicle follows a path dictated by said mechanical track.

6. The stretch-wrap machine of claim 5 wherein said mechanical track is an upstanding rail.

7. The stretch-wrap machine of claim 6 wherein said upstanding rail is for mounting about the stationary material to be wrapped and said track follower is mounted on a control arm extending away from the main frame of said motive unit so that said vehicle passes around the outside of said track.

8. The stretch-wrap machine of claim 6 wherein said rail is mounted on the floor and extends around the stationary material to be wrapped, and said mechanical track follower is mounted on said vehicle and engages said rail.

9. The stretch-wrap machine of claim 5 wherein said mechanical track comprises a U-shaped track extending around the stationary material to be wrapped and said mechanical track follower is a track follower pin mounted on said vehicle and engaged in said track for guidance of said vehicle around the material to be wrapped.

10. The stretch-wrap machine of claim 1 wherein a digital coding track is positioned with respect to the material to be wrapped and a sensor is mounted to move with said vehicle, said sensor reading said digital coding, said sensor being part of said guidance control means so that said vehicle moves around the material to be wrapped.

11. The stretch-wrap machine of claim 10 wherein said stretch-wrap unit is connected to said sensor to be controlled by said digital coding track so that stretch-wrapping of the stationary material is controlled.

12. The stretch-wrap machine of claim 1 wherein said vehicle comprises a frame supported on said wheels and said stretch-wrap unit comprises rails extending upright from said frame, said supply of stretch-wrap web comprising a roll of web supported rotatably on said rails by means of a carriage that moves along said rails reciprocatively.

* * * * *